US007000876B2

(12) United States Patent
Searcy

(10) Patent No.: US 7,000,876 B2
(45) Date of Patent: Feb. 21, 2006

(54) TRAY FOR LADDER BRACKET

(75) Inventor: Marilyn Searcy, Fremont, CA (US)

(73) Assignee: Searcy Enterprises, Fremont, CA (US)

( * ) Notice: Subject to any disclaimer, the term of this patent is extended or adjusted under 35 U.S.C. 154(b) by 481 days.

(21) Appl. No.: 10/230,780

(22) Filed: Aug. 27, 2002

(65) Prior Publication Data

US 2004/0217241 A1 Nov. 4, 2004

(51) Int. Cl.
*E06C 7/14* (2006.01)

(52) U.S. Cl. ..... 248/210; 248/238; 248/211; 248/225.21; 182/129; 108/42; 108/47; 220/476; 224/926

(58) Field of Classification Search ..... 206/567, 206/557; 108/42, 47, 49, 50.14, 25; 220/476, 220/480, 737; 224/926, 482, 547, 558; 248/210, 248/238, 211, 221.11, 223.4, 225.21; 40/796, 40/753; 403/11, 12; 182/129; 211/133.6, 211/88.01

See application file for complete search history.

(56) References Cited

U.S. PATENT DOCUMENTS 1,041,776 A * 10/1912 Gibson ..... 40/732
1,168,832 A * 1/1916 Smernoff ..... 40/790
1,217,676 A * 2/1917 Wilson ..... 108/25
1,222,468 A * 4/1917 Rosen ..... 40/796
2,214,204 A * 9/1940 Pollard ..... 297/171
3,062,602 A * 11/1962 O'Brien et al. ..... 5/3
3,068,048 A * 12/1962 Mahon et al. ..... 297/188.15
3,665,629 A * 5/1972 Shore ..... 40/790
5,573,164 A * 11/1996 Law ..... 224/483
5,816,363 A * 10/1998 Searcy ..... 182/129
6,824,115 B1 * 11/2004 Batson ..... 248/238

* cited by examiner

*Primary Examiner*—Kimberly Wood
(74) *Attorney, Agent, or Firm*—Harris Zimmerman

(57) ABSTRACT

A tray for use in conjunction with a ladder bracket includes a plurality of upwardly opening compartments that may be used to hold paint, tools, or other painting supplies or implements. The bottom of the painter's tray is provided with structural features to engage a ladder bracket. A pair of downwardly opening channels are formed in the bottom surface, the channels being continuous, concentric, and curved in circular fashion to receive the hoop portion of two common sizes of ladder brackets. Both channels open to a slot opening that receives the tang portion of the ladder bracket. A plurality of tab members are mounted on posts extending downwardly from the bottom of the tray, and are rotatable to extend over the channels and secure a ladder bracket hoop portion therein.

12 Claims, 3 Drawing Sheets

TRAY FOR LADDER BRACKET

BACKGROUND OF THE INVENTION

The present invention relates to paint container holders supported by ladders, and, more particularly, to a paint container holder that may also support a utility/painter's tray.

In utilizing a ladder a painter is confronted with the problem of supporting a paint container or a tray in a position where it is convenient to add paint to the brush, roller, or other painting tool. It is notably inconvenient, and even dangerous, for the painter to use one hand to hold the paint container while wielding a brush with the other hand. In response to this problem, some ladders such as stepladders are provided with a fold-out shelf adjacent to the top thereof to support a paint can or tray. These fold-out shelves are notoriously unstable and unreliable, providing ample opportunity for the container to fall therefrom during normal use of the ladder.

There are other devices known in the prior art for supporting paint containers on ladders. These devices generally comprise brackets of various forms that are removably secured to rungs of a ladder, or the ladder rail, or some combination of the two. One notable example, U.S. Pat. No. 5,816,363, issued to the present inventor, shows a ladder bracket that provides a cantilevered hoop to support either a paint bucket or a utility/painter's tray. The latter implement is provided with a plurality of channel members extending downwardly from a bottom surface, the channel members disposed in confronting, spaced apart fashion to receive and engage therebetween portions of the hoop. In addition, guide blocks are provided at the bottom surface to define a gap in which the tang of the bracket may be received.

This arrangement permits the quick removal and substitution of a paint tray for a paint bucket, by merely lifting the bucket from the hoop, and installing the tray by sliding the tray channel members onto the hoop portions with the tang portion between the guide blocks.

In some situations it may be advantageous to fasten the tray to the ladder bracket more securely, as, for example, when it is desirable to assemble the tray to the bracket before the bracket is installed on a ladder. The present invention addresses this concern.

Also, it has been found that the prior art is replete with various forms of ladder brackets having hoop portions of differing diameters. It would be advantageous to be able to fabricate and sell one painter's tray that is adapted to securely engage and be supported by the ladder brackets of various diameters. The present invention addresses this concern, also.

SUMMARY OF THE INVENTION

The present invention generally comprises a painter's tray for use in conjunction with a ladder bracket that supports a paint bucket or canister on the step or rung of a ladder. A salient feature of the invention is that it is designed to be used with ladder brackets of differing sizes and configurations.

The painter's tray includes a plurality of upwardly opening coffers, or compartments, that may be used to hold paint, tools, or other painting supplies or implements. One compartment preferably is provided with a sloping bottom surface, and has sufficient width and depth to serve as a paint container for a paint roller of dimensions standard in the industry. Other compartments may be dimensioned to hold smaller quantities of paint or preparation materials (patch materials, surface materials, and the like) or tools such as scrapers, brushes, spray accessories, and the like.

In one compartment layout, a generally rectangular paint roller compartment extends substantially the entire width (between opposed sides) of the tray, and approximately half of the length (between opposed ends.) A plurality of accessory compartments are disposed in the remainder of the tray, arrayed side-by-side between the opposed sides of the tray.

The bottom of the painter's tray is provided with structural features to engage a ladder bracket, such as the one shown in U.S. Pat. No. 5,816,363. A pair of downwardly opening channels are formed in the bottom surface, the channels being continuous, concentric, and curved in circular fashion. The two channels are dimensioned to receive the hoop portion of two common sizes of ladder brackets. Both channels open to a slot opening that receives the tang portion of the ladder bracket (of either size). Disposed adjacent to the channels are a plurality of tab members that are mounted on posts extending downwardly from the bottom of the tray. The tab members are rotatable to extend over the channels and secure a ladder bracket hoop portion therein. The tab members thus releasably join the painter's tray to the ladder bracket in a very secure fashion. Thus, for example, the tray may be assembled to the ladder bracket and mounted on and removed from a ladder as an assembled unit. Likewise, once the assembled unit is mounted on a ladder, the tray cannot be separated accidentally from the ladder bracket.

The channels may be defined by a plurality of curved wall structures extending downwardly from the bottom of the painter's tray. An inner cylindrical wall defines the innermost extent of an inner channel, and a first medial wall extends concentrically about the inner wall for substantially the entire length thereof to define therebetween a first arcuate channel. The first medial wall terminates at the slot opening. An outer wall extends concentrically about the inner wall and first medial wall, and includes flared end portions that define the slot opening. A second medial wall extends concentrically within the outer wall for substantially the entire length thereof to define therebetween a second arcuate channel.

The tab members and mounting posts are preferably located within the inner wall, the tab members being of sufficient length to extend to span both the inner and outer concentric channels.

The painter's tray may be fabricated by molding techniques known in the prior art, such as injection molding, rotational molding, vacuum forming, and the like.

DESCRIPTION OF THE PREFERRED EMBODIMENT

Figure 1:
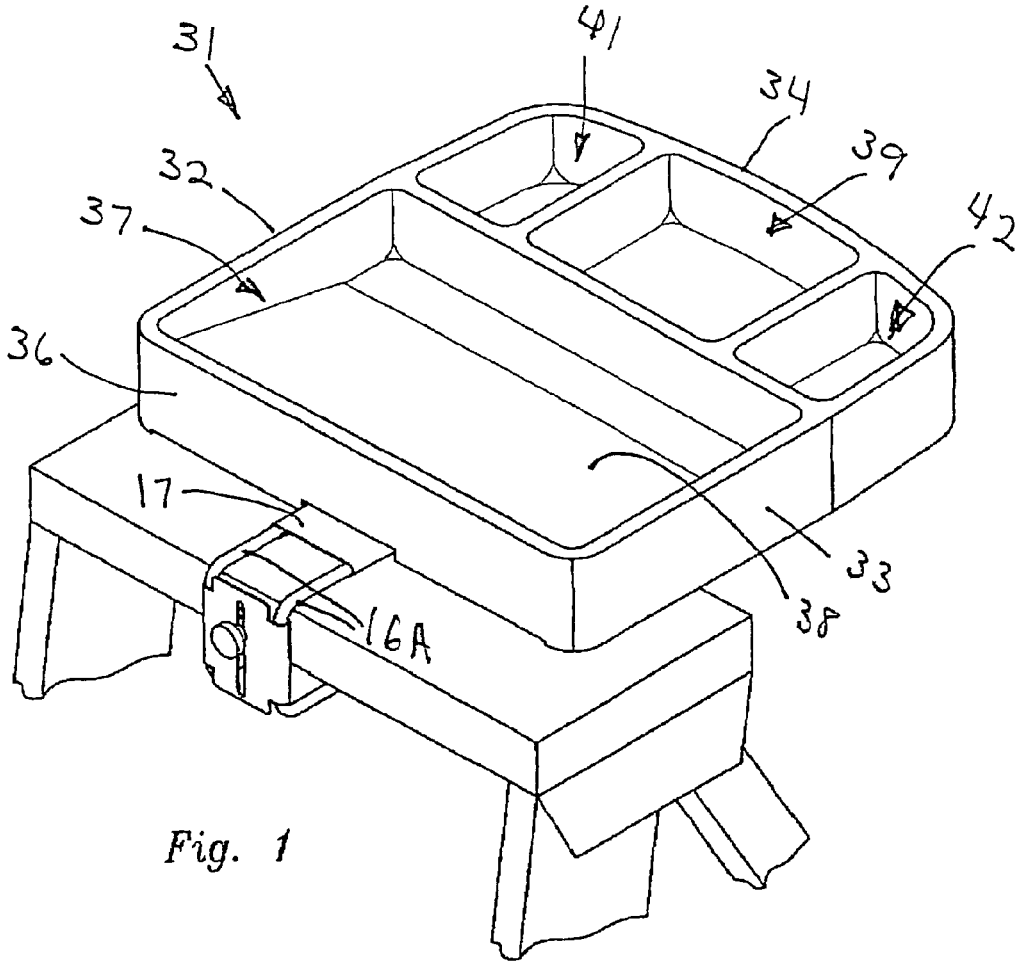
FIG. 1 is a top perspective view showing the painter's tray secured to a ladder bracket which is assembled to a ladder.

The present invention generally comprises a painter's tray for use in conjunction with a ladder bracket that supports a paint bucket or canister on the step or rung of a ladder. With regard to FIG. 3, a typical ladder bracket 11 includes an arcuate portion 12 comprised of stiff wire or rod material 14 formed in a smooth curved shape defines a central opening 13. The opening 13 is dimensioned to receive a paint container or bucket having a (typical) standard size such as 2 gallons, 5 gallons, or the like. The wire or rod 14 describes substantial portion of a closed curved loop, whereby a cylindrical container may be encircled and supported within.

Figure 2:
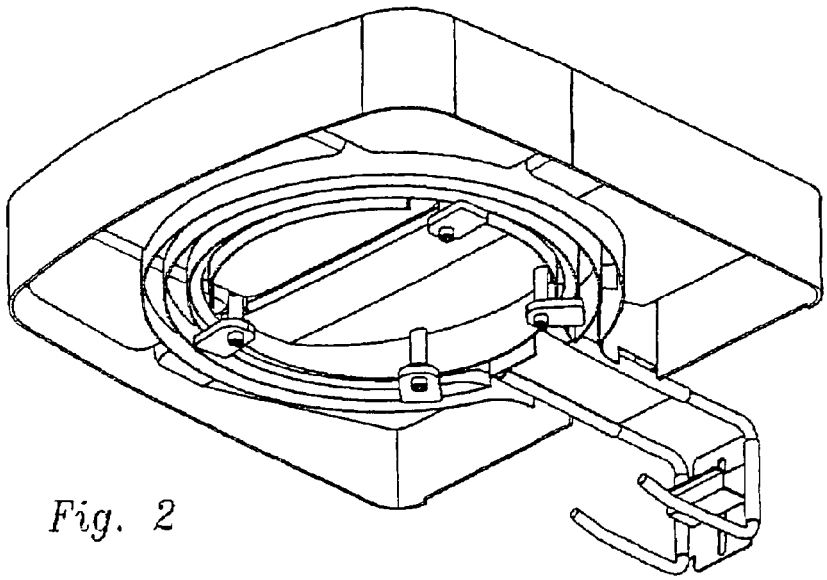
FIG. 2 is a bottom perspective view showing the painter's tray secured to a ladder bracket.
Figure 3:
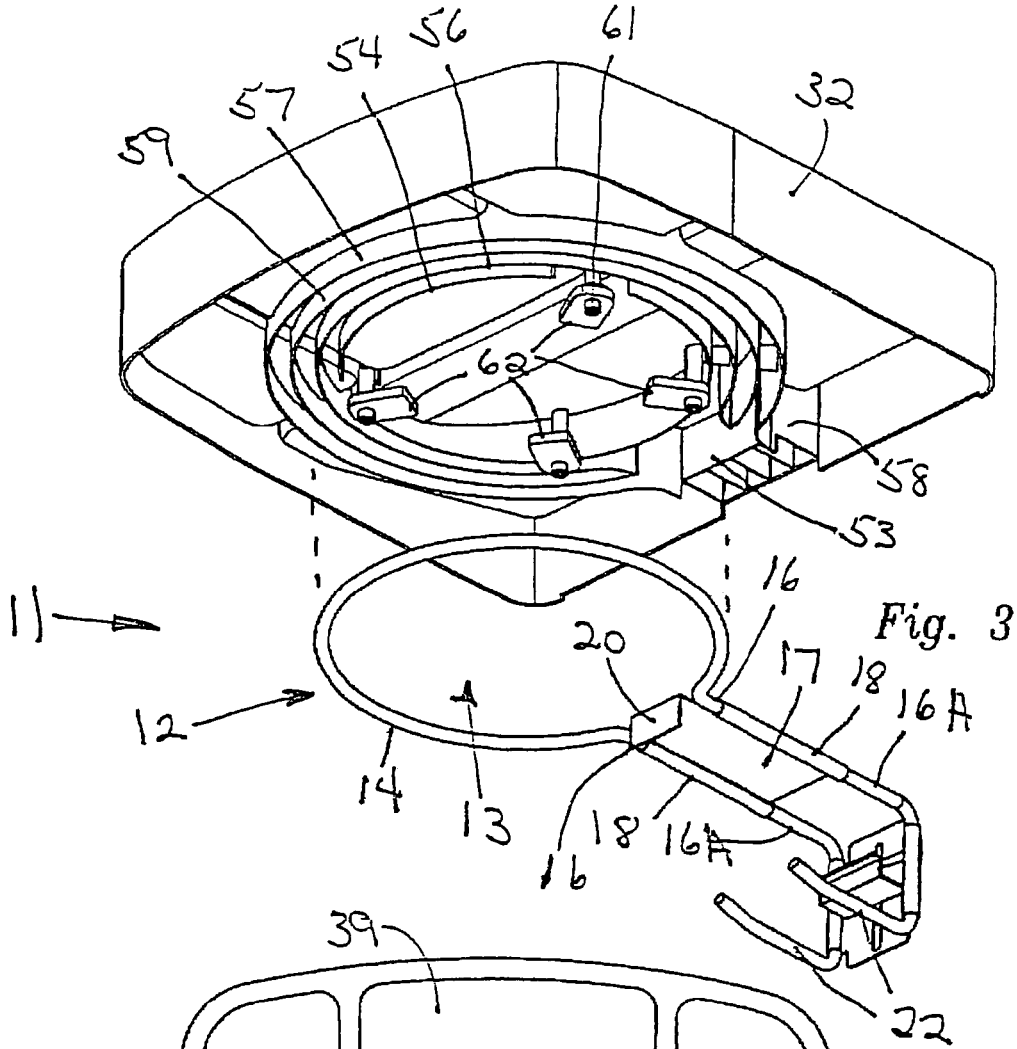
FIG. 3 is an exploded perspective view from below showing the painter's tray and a ladder bracket.
Figure 4:
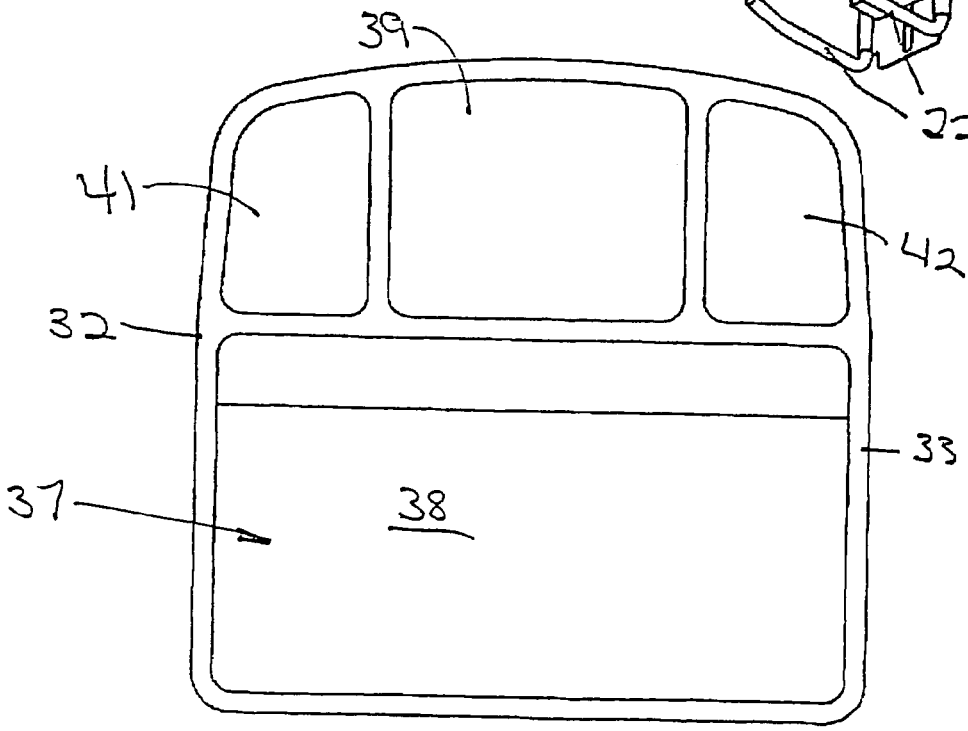
FIG. 4 is a top plan view of the painter's tray of the present invention.

The wire or rod member 14 extends integrally from the arcuate portion 12 as a pair of linear portions 16 disposed in parallel, spaced apart fashion. A tang member 17 comprised of a plate-like component includes opposed sides having curved edge portions 18 that substantially circumscribe and secure the linear portions 16, forming a rigid assembly therewith. A flange 20 is formed at one end of the tang 17 and extends between the linear segments 16, as shown in FIGS. 2 and 3. The paired linear segments extend proximally past the tang 17 as segments 16A, and undergo right angle bends to form short transition segments 21 that converge slightly each toward the other. Further right angle bends define retrograde segment 22 that extend generally parallel to their respective progenitor portions 16A. The segments 22 and 16A define therebetween an opening 24 dimensioned to receive a step or rung of a ladder.

With regard to FIG. 1, the painter's tray 31 of the invention includes opposed sides 32 and 33 and opposed ends 34 and 36 that define a generally rectangular tray structure. A plurality of upwardly opening coffers, or compartments, in the tray 31 includes a paint roller compartment 37 for applying paint to a roller and having a sloping bottom surface 38 on which a paint roller may be impinged and rotated to absorb and distribute paint, as in known in the prior art. The compartment 37 has sufficient width and depth to serve as a paint container for a paint roller of dimensions standard in the decorative trades. The compartment 37 extends substantially the entire width between opposed sides 32 and 33 of the tray, and approximately half of the length between opposed ends 34 and 36. The remainder of the upper surface of the tray 31 is provided with a medial compartment 39 and two side compartments 41 and 42.

The compartments 39, 41, and 42 may be configured to hold various tools and implements for surface preparation, such as scrapers, tape, brushes, and other paraphernalia. Alternatively, the tray 31 may be configured for faux painting, with each compartment containing different color paints. One compartment may include a dabbing screen for removing excess paint from the faux applicators.

Figure 5:
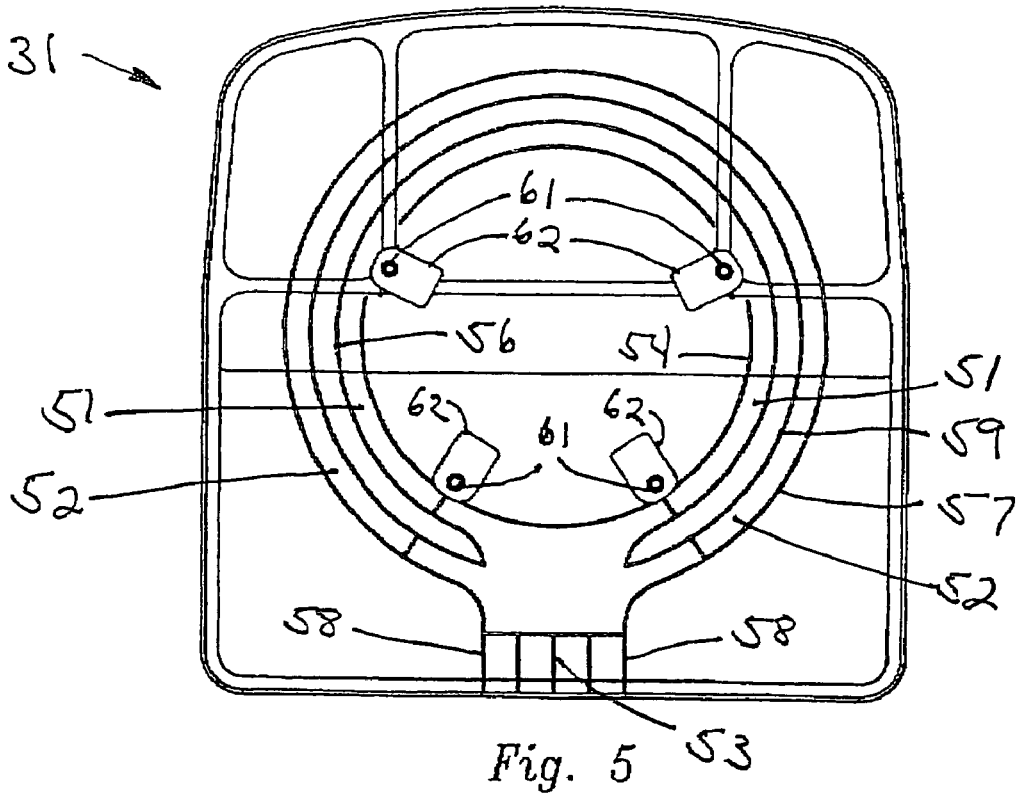
FIG. 5 is a bottom plan view of the painter's tray of the present invention.
Figure 6:
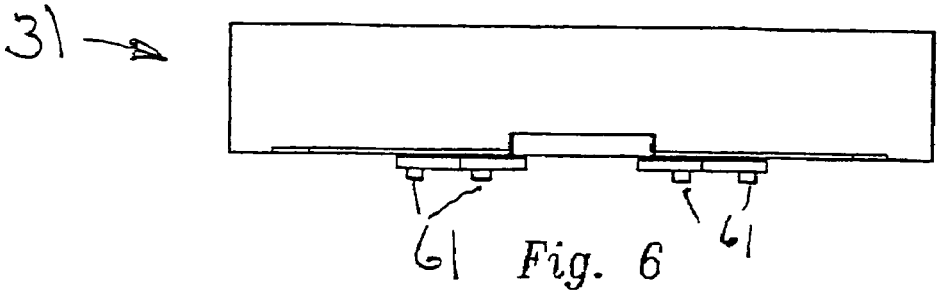
FIG. 6 is an end elevation of the painter's tray of the present invention.

With regard to FIGS. 2, 3, and 5, the bottom of the painter's tray is provided with structural features to engage a ladder bracket, such as the one shown in U.S. Pat. No. 5,816,363, or the like. A pair of arcuate channels 51 and 52 open downwardly from the bottom of the tray, and are generally continuous, concentric, and circular. The channels 51 and 52 are dimensioned to receive different standard sizes of the hoop portions 12 of a typical ladder bracket. Both channels extend through substantial portions of a circular arc, the opposed ends of the channels communicating with a slot opening 53. The slot opening 53 is dimensioned to receive the tang portion 17 of a ladder bracket, so that painter's tray is supported and immobilized by the engagement of the hoop and tang in one of the channels and the opening 53.

In the preferred embodiment, the channels 51 and 52 are defined by a plurality of curved wall structures extending downwardly from the bottom of the painter's tray. An inner cylindrical wall 54 delimits the inner extent of the channel 51, and a medial wall 56 extends concentrically about the inner wall 54 for substantially the entire length thereof to define therebetween the channel 51. An outer wall 57 extends concentrically about the inner wall 54 and medial wall 56, and includes flared, parallel end portions 58 that define the slot opening 53. Another medial wall 59 extends concentrically within the outer wall 57 for substantially the entire length thereof to define therebetween the channel 52. The respective end portions of the medial walls 56 and 59 are joined together at locations that define a gap that further defines the slot opening 53.

Figure 7:
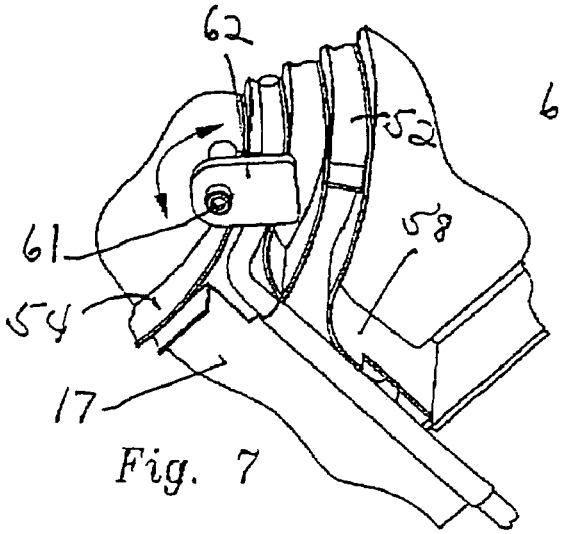
FIG. 7 is a partial perspective view showing a ladder bracket hoop portion engaged in a channel of the painter's tray and secured by a tab member.
Figure 8:
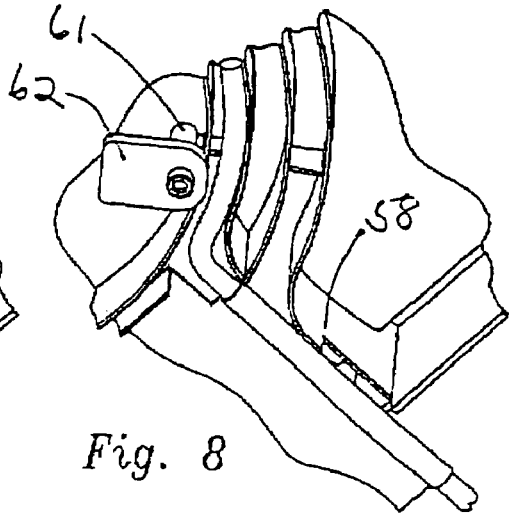
FIG. 8 is a partial perspective view as in FIG. 7, shown with the tab member in released position.

The painter's tray further includes fasteners for releasably securing the tray to a ladder bracket. A plurality of posts 61 extend downwardly from the bottom of the tray, and are arrayed at angularly spaced intervals within the inner wall 54. A plurality of tab members 62 are provided, each secured in rotatable fashion to a respective post 61 at the lower end thereof. The tabs 62 have sufficient length so that they may be rotated to extend and span the channels 51 and 52. The tabs 62 may be rotated inwardly, as shown in FIGS. 3, 5 and 8, to open the channels 51 and 52 to receive the hoop portion of a ladder bracket. After the hoop portion is inserted in the appropriate channel 51 or 52 (with the tang portion in the slot opening 53), the tabs may be rotated to span the channels and retain the hoop portion in the channel, as shown in FIGS. 2 and 7. Thereafter, the tray 31 is well secured to the ladder bracket, and may be transported and installed as a single assembly. Of course, the tray may be removed easily from the ladder bracket by rotating the tab members to open the channels and release the hoop portion from the channel, and the ladder bracket may then be used to support a bucket or canister of paint.

In the embodiment depicted, the sides 32 and 33, ends 34 and 36, and compartments 37, 39, 41 and 42 are defined by a single panel of plastic or polymer material that may be formed in a single operation to create all these features. The walls 54, 56–59 may extend downwardly from the bottom surface of the single panel, and other reinforcing ribs or fillets may be formed likewise. Other design and fabricating techniques may be used without departing from the spirit and teachings of the invention. Note also that only one, or more than two channels may be formed in the bottom of the tray, and that the design of compartments in the top of the tray may incorporate a wide variety of compartment sizes and arrangements, as required to suit the uses of the product.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A utility tray in combination with a ladder bracket having a supporting hoop portion and tang portion, said utility tray comprising:

at least one channel formed in the bottom of said utility tray, said at least one channel having an arcuate plan conformation that is continuously curved in complementary fashion to the hoop portion of the ladder bracket and receives the hoop portion; and, means for releasably securing the hoop portion in said at least one channel.

2. A utility tray in combination with a ladder bracket having a supporting hoop portion and a tang portion, including:

at least one channel formed in the bottom of said utility tray, said at least one channel curved in complementary fashion to the hoop portion of the ladder bracket:

means for releasably securing the hoop portion in said at least one channel;

wherein said means for releasably securing includes at least one tab member mounted adjacent to said at least one channel, and means for reversibly rotating said tab member from a first position in which said tab member spans said at least one channel and retains the hoop portion therein, to a second position in which said tab member does not span said at least one channel and the hoop portion may be inserted and removed from said at least one channel.

3. The utility tray of claim 2, further including a plurality of channels formed in the bottom of said tray, each channel dimensioned to receive a hoop portion having a differing curved conformation.

4. The utility tray of claim 3, wherein said plurality of channels are disposed concentrically.

5. The utility tray of claim 4, wherein said at least one tab member is dimensioned to span said plurality of channels in said first position.

6. The utility tray of claim 5, wherein said at least one tab member is disposed within the innermost concentric channel of said plurality of channels.

7. The improved utility tray of claim 5, further including a plurality of tab members, each reversibly rotatable from said first position to said second position.

8. The utility tray of claim 3, wherein said plurality of channels are defined by a plurality of curved walls extending downwardly from the bottom of said tray.

9. The utility tray of claim 8, wherein said plurality of curved walls are disposed generally concentrically.

10. The utility tray of claim 9, wherein said plurality of curved walls includes an outermost wall, said outermost wall includes a continuous curved main portion and flared end portions.

11. The utility tray of claim 10, wherein said flared end portions are disposed in spaced apart fashion to define a slot opening in the bottom of said utility tray, said slot opening being dimensioned to receive the tang portion of the ladder bracket.

12. The improved utility tray of claim 7, wherein said plurality of tab members are disposed within the innermost concentric channel of said plurality of channels.

* * * * *